US008541956B2

(12) United States Patent
Lee et al.

(10) Patent No.: US 8,541,956 B2
(45) Date of Patent: Sep. 24, 2013

(54) LIGHT EMITTING DIODE DRIVING METHOD AND DRIVING CIRCUIT

(75) Inventors: Hung-Ching Lee, Hsin-Chu (TW); Ching-Chou Yu, Hsin-Chu (TW); Sheng-Kai Hsu, Hsin-Chu (TW); Dang-Ko Wang, Hsin-Chu (TW)

(73) Assignee: Au Optronics Corp., Hsinchu (TW)

( * ) Notice: Subject to any disclaimer, the term of this patent is extended or adjusted under 35 U.S.C. 154(b) by 300 days.

(21) Appl. No.: 13/042,946

(22) Filed: Mar. 8, 2011

(65) Prior Publication Data

US 2012/0019160 A1 Jan. 26, 2012

(30) Foreign Application Priority Data

Jul. 23, 2010 (TW) ..... 99124381 A

(51) Int. Cl.
*H05B 37/02* (2006.01)

(52) U.S. Cl.
USPC ..... 315/291; 315/307; 315/360

(58) Field of Classification Search
USPC ..... 315/247, 250, 287, 291, 294, 297, 315/307–308, 360
See application file for complete search history.

(56) References Cited

U.S. PATENT DOCUMENTS

| | | | | |
|---|---|---|---|---|
| 6,943,504 | B1 * | 9/2005 | York | 315/224 |
| 8,217,592 | B2 | 7/2012 | Yu et al. | |
| 2009/0167197 | A1 * | 7/2009 | Wang et al. | 315/185 R |
| 2009/0230880 | A1 * | 9/2009 | Wang et al. | 315/294 |
| 2009/0267538 | A1 * | 10/2009 | Mantovani | 315/297 |
| 2010/0072922 | A1 * | 3/2010 | Szczeszynski et al. | 315/297 |
| 2011/0115394 | A1 * | 5/2011 | Shteynberg et al. | 315/250 |

FOREIGN PATENT DOCUMENTS

| | | |
|---|---|---|
| CN | 101500361 | 8/2009 |
| CN | 101605415 | 12/2009 |
| EP | 2079156 | 7/2009 |
| EP | 2068600 | 10/2009 |
| WO | 2010022182 | 2/2010 |

* cited by examiner

*Primary Examiner* — Tung X Le
(74) *Attorney, Agent, or Firm* — WPAT, PC; Justin King

(57) ABSTRACT

A LED driving method includes steps of: providing a first pulse width modulation (PWM) signal for determining a brightness of a LED; obtaining a duty cycle of the first PWM signal; and selectively enabling the LED to work with a PWM dimming mode or a direct current (DC) dimming mode according to a relative relationship between a magnitude of the obtained duty cycle and a preset threshold value. Since the LED is performed with a two stage brightness control by use of mixed dimming mode, the driving efficiency of the LED can be improved.

14 Claims, 3 Drawing Sheets

LIGHT EMITTING DIODE DRIVING METHOD AND DRIVING CIRCUIT

FIELD OF THE INVENTION

The present invention relates to light emitting diode (LED) driving technology, and more particularly to an LED driving method and an LED driving circuit.

BACKGROUND OF THE INVENTION

Display panel of a non-self-luminous display (such as, a liquid crystal display) cannot emit light; a backlight is thus needed to provide backlighting for the display panel. Currently, backlights can include Cold Cathode Fluorescent Lamps (CCFL), Hot Cathode Fluorescent Lamps (HCFL), Light Emitting Diodes (LED), and other electroluminescence (ELC) components. LEDs are prevalently used as backlights of liquid crystal display (LCD), for high color saturation, no mercury, long life, low energy consumption, and adjustable color temperature according to driving current.

Currently, in order to reduce power consumption of LED backlight of the LCD and/or enhance the display contrast, PWM dimming mode is proposed to use PWM signal to drive LEDs and thus dynamically adjust backlight brightness of LED backlight. However, the current LED driving mode has the following disadvantages: (a) driving current of the LED is a fixed value and cannot be automatically adjusted according to usage of the LED; (b) the driving current of the LED is fixed to the current at the maximum gray-scale brightness, while driven at non-maximum gray-scale brightness by use of the fixed current 1, the LED will work in a low efficiency area.

SUMMARY OF THE INVENTION

Therefore, the present invention relates to a LED driving method which can adjust the current value and duty cycle of the LED driving current, in order to effectively improve the driving efficiency of the LED.

The present invention further relates to a LED driving circuit which can automatically adjust the current value and duty cycle of the LED driving current according to usage of the LED, in order to effectively improve the driving efficiency of the LED.

Specially, a LED driving method according to an embodiment of the present invention comprises: providing a first pulse width modulation signal to determine brightness of a LED; obtaining a duty cycle of the first pulse width modulation signal; and selectively enabling the LED to work with a pulse width modulation dimming mode or a direct current dimming mode according to a relative relationship between a magnitude of the duty cycle and a preset threshold value. Preferably, the preset threshold value is 25%.

In an embodiment of the present invention, the step of selectively enabling the LED to work with the pulse width modulation dimming mode or a direct current dimming mode according to a relative relationship between a magnitude of the duty cycle and a preset threshold value comprises: enabling the LED to work with the pulse width modulation dimming mode when the duty cycle is less than the preset threshold value; and enabling the LED to work with the direct current dimming mode when the duty cycle is no less than the preset threshold value.

In an embodiment of the present invention, when the LED works with the pulse width modulation dimming mode, the duty cycle of the LED driving current is determined by the duty cycle of the first pulse width modulation signal and the preset threshold value, and the current value of the driving current in the duty cycle of the LED driving current is determined by a maximum gray-scale current value of the LED and the preset threshold value. The current value of the LED driving current is determined by the maximum gray-scale current value of the LED and the duty cycle of the first pulse width modulation signal, when the LED works with the direct current dimming mode.

In an embodiment of the present invention, the step of obtaining the duty cycle of the first pulse width modulation signal comprises: counting during a frequency cycle of the first pulse width modulation signal to obtain a frequency cycle count and a duty cycle count of the first pulse width modulation signal; and calculating the duty cycle of the first pulse width modulation signal during the frequency cycle according to the frequency cycle count and the duty cycle count. The step of obtaining the duty cycle of the first pulse width modulation signal further comprises: directly setting the duty cycle in the subsequent frequency cycle to be 100% until a rising edge of the first pulse width modulation signal is detected, after the duty cycle of the first pulse width modulation signal is maintained to be 100% in two consecutive frequency cycles.

In an embodiment of the present invention, the LED driving method further comprises: closing the LED, if a rising edge of the first pulse width modulation signal is not detected in two consecutive frequency cycles after the falling edge of the first pulse width modulation signal.

In an embodiment of the present invention, the step of enabling the LED to work with the pulse width modulation dimming mode when the duty cycle is less than the preset threshold value comprises: generating a digital signal according to the preset threshold value; implementing an algorithm according to the frequency cycle count and the duty cycle count to generate a second pulse width modulation signal; and respectively setting the duty cycle of a LED driving current and the current value of the driving current in the set duty cycle, according to the digital signal of the second pulse width modulation signal; wherein the implementation of the algorithm is to make the duty cycle of the second pulse width modulation signal to be the quotient of the duty cycle of the first pulse width modulation signal divided by the preset threshold value. The step of enabling the LED to work with the direct current dimming mode when the duty cycle is no less than the preset threshold value comprises: generating a digital signal according to the duty cycle; and setting the current value of the driving current provided to the LED, according to the digital signal.

A LED driving circuit according to another embodiment of the present invention comprises: a counting circuit, a calculating circuit, a pulse width modulation signal generating circuit, a driving current setting circuit, and a dimming mode selecting circuit. The counting circuit receives the first pulse width modulation signal and counting during a frequency cycle of the first pulse width modulation signal to generate a frequency cycle count and a duty cycle count of the first pulse width modulation signal, and the first pulse width modulation signal determines brightness of the LED. The calculating circuit calculates a duty cycle of the first pulse width modulation signal during the frequency cycle, according to the frequency cycle count and the duty cycle count. The pulse width modulation signal generating circuit generates a second pulse width modulation signal by implementing an algorithm according to the frequency cycle count and the duty cycle count. The driving current setting circuit is electrically coupled to the calculating circuit and the pulse width modulation signal generating circuit. The dimming mode selecting circuit determines relative relationship of magnitude of the duty cycle of the first pulse width modulation signal and a preset threshold value, and determines whether the second pulse width modulation signal is provided to the driving current setting circuit according to the relative relationship to selectively enable the LED to work with: a pulse width modulation dimming mode with which a duty cycle of a LED driving current is set according to the second pulse width modulation signal, or a direct current dimming mode.

In an embodiment of the present embodiment, the driving current setting circuit comprises: a first digital signal generating circuit and a second digital signal generating circuit. The first digital signal generating circuit generates a first digital signal according to a preset threshold value. The second digital signal generating circuit generates a second digital signal according to the duty cycle. When the LED is driven by the driving current setting circuit to work with the pulse width modulation dimming mode, the driving current setting circuit is controlled by the dimming mode selecting circuit to select the first digital signal to set the current value of the driving current during the duty cycle. When the LED is driven by the driving current setting circuit to work with the direct current dimming mode, the driving current setting circuit is controlled by the dimming mode selecting circuit to select the first digital signal to set the current value of the driving current.

In an embodiment of the present embodiment, the driving current setting circuit further comprises: a digital/analog converting circuit, a current generating circuit and a comparator circuit. The digital/analog converting circuit converts the selected one of the first digital signal and the second digital signal to an analog signal. The current generating circuit generates the current value of the driving current according to the analog signal and a reference current. The comparator circuit determines the lighting time of the LED and comprises a controlling end, a first input and a second input. The controlling end is electrically coupled to the pulse width modulation signal generating circuit to determine which one of the pulse width modulation dimming mode and the direct current dimming mode the LED driven by the driving current setting circuit works with, and the first input receives the current value outputted by the current generating circuit, and the second input receives a feedback current from the LED.

A LED driving method according to a further embodiment of the present invention comprises steps of: obtaining a duty cycle of an initial pulse width modulation signal to determine brightness of the LED; respectively setting a duty cycle of a LED driving current and a current value of the driving current during the set duty cycle to be D %/T and Iset×T, when the duty cycle of the initial pulse width modulation signal is less than a preset threshold value, wherein D % is the value of the duty cycle of the driving current, T is the threshold value, $0<T<1$, Iset is a preset maximum gray-scale current of the LED; and respectively setting the duty cycle of the driving current and the current value of the driving current during the duty cycle of the driving current to be 100/5 and Iset×D %, when the duty cycle of the initial pulse width modulation signal is no less than the preset threshold value. Preferably, the threshold value is 25%.

In the LED driving method and circuit according to the embodiments of the present invention, the LED is performed with a two stage brightness control by use of mixed dimming mode. The current value and the duty cycle of the LED driving current can be automatically adjusted according to usage of the LED; the driving efficiency of the LED can thus be improved.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
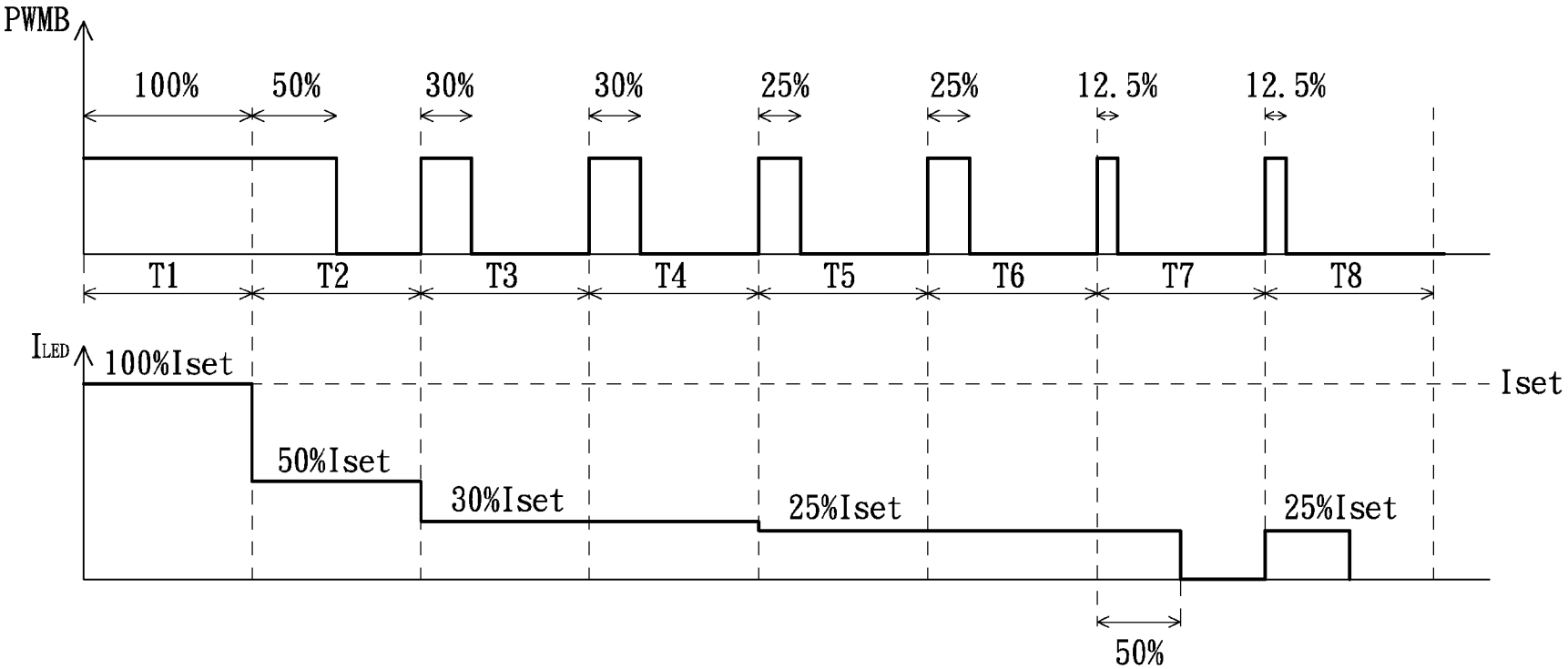
FIG. 1 is a timing diagram of multiple signals of a LED driving method in accordance with an embodiment of the present invention.

Please referring to FIG. 1, it is a timing diagram of multiple signals of a LED driving method, in accordance with an embodiment of the present invention. The LED driving method of the embodiment can be applied to drive a non-self-luminous backlight of a display, but not limited to the present invention. The LED driving method in accordance with the present embodiment is detailed descript A detailed description of the LED driving method in accordance with the present embodiment is as follows, in combination with FIG. 1.

Specifically, the LED driving method of the present embodiment may include steps of: providing a pulse width modulation signal PWMB to determine the brightness of the LED, obtaining a duty cycle of the pulse width modulation signal PWMB, and selectively enabling the LED to work with a PWM dimming mode or a direct current (DC) dimming mode according to a relative relationship between a magnitude of the obtained duty cycle and a preset threshold value. In this embodiment, the preset threshold value is set to be 25%, according to the actual measured best pin rate curve of driving LED. Of course, different products may have different best pin rate curve of driving LED, so the preset threshold value can have a proper adjustment based on the actual application.

As shown in FIG. 1, the duty cycles of the pulse width modulation signal PWMB in its consecutive eight frequency cycles T1~T8 are in turn 100%, 50%, 30%, 30%, 25%, 25%, 12.5% and 12.5%. When the duty cycle of the pulse width modulated signal PWMB is greater than and equal to 25%, for example, in turn equal to 100%, 50%, 30% and 25%, the duty cycle of the LED driving current $I_{LED}$ is set to be 100%, and the current values of the driving current $I_{LED}$ are in turn 100% Iset, 50% Iset, 30% Iset and 25% Iset, wherein Iset is the preset maximum gray-scale current of the LED. In other words, when the duty cycle of the pulse width modulation signal PWMB is greater than and equal to the preset threshold value, the LED works with a DC dimming mode. On the other hand, when the duty cycle of the pulse width modulated signal PWMB is less than 25%, for example, equal to 12.5%, the duty cycle of the LED driving current $I_{LED}$ is set to be 12.5%/25%=50%, and the current value of the driving current $I_{LED}$ is Iset×25%=25% Iset. In other words, when the duty cycle of the pulse width modulation signal PWMB is less than the preset threshold value, the LED works with a PWM dimming mode.

In short, in the LED driving method of this embodiment: (a) when the duty cycle of the PWM signal PWMB is greater than and equal to the preset threshold value, and less than and equal to 100%, the LED works with the DC dimming mode, and employs the duty cycle of the pulse width modulation signal PWMB to modulate the amplitude of the LED driving current ILED; (b) when the duty cycle of the pulse width modulation signal PWMB is less than the preset threshold value, the LED works with the PWM dimming mode, and the current value of the LED driving current is fixed to the product of the preset threshold value and the preset maximum gray-scale current Iset, and the duty cycle of the driving current $I_{LED}$ is set to the quotient of the duty cycle of the pulse width modulation signal divided by the preset threshold value Please referring to FIG. 2, it is a block diagram of a LED driving circuit in accordance with an embodiment of the present invention. In this embodiment, the LED driving circuit 100 can drive the LED to selectively work with the DC dimming mode or the PWM dimming mode.

Figure 2:
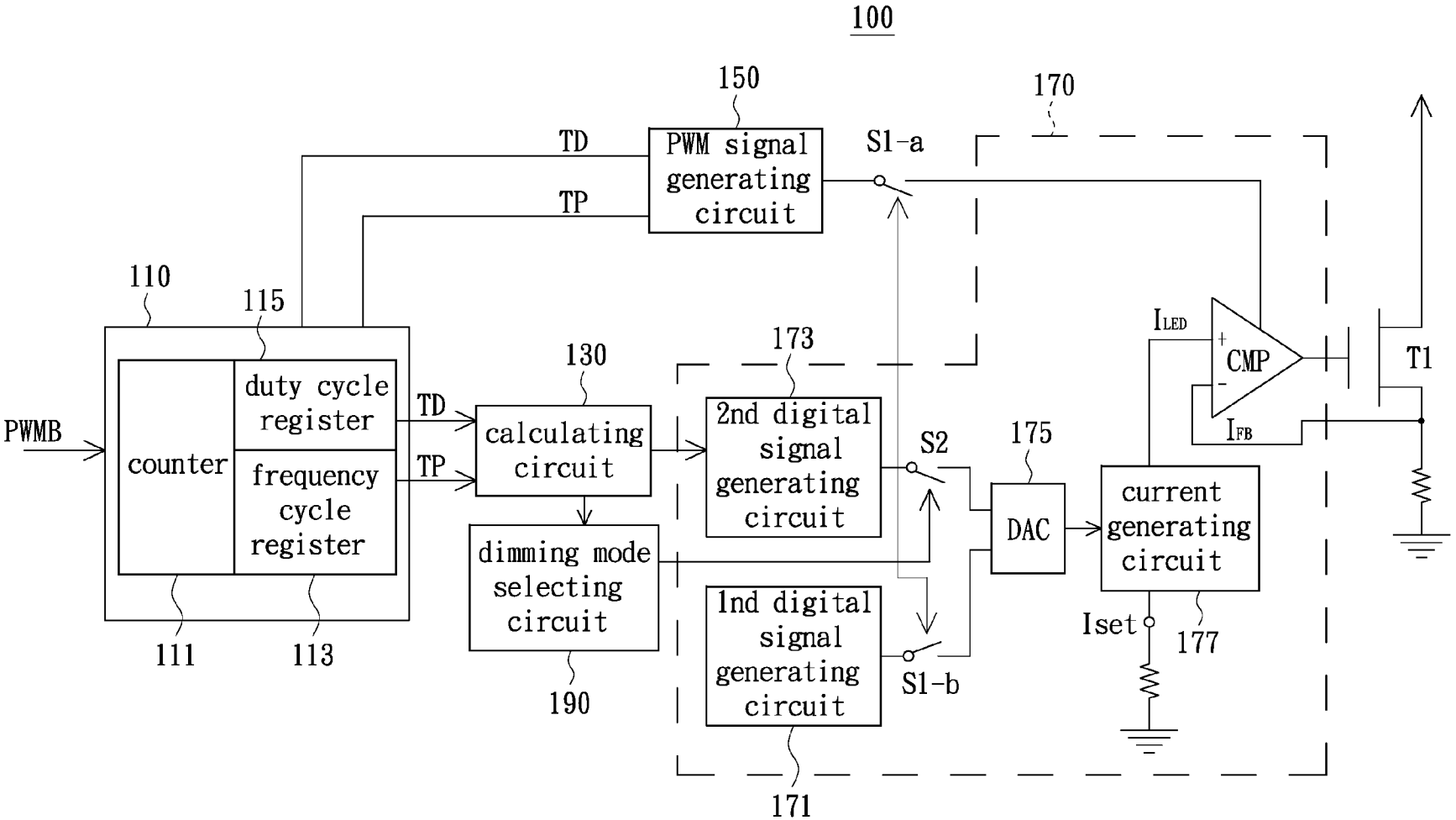
FIG. 2 is a block diagram of a LED driving circuit in accordance with an embodiment of the present invention.

Specifically, as shown in FIG. 2, the LED driving circuit 100 comprises a counting circuit 110, a calculating circuit 130, a PWM signal generating circuit 150, a driving current setting circuit 170, and a dimming mode selecting circuit 190.

The counting circuit 110 receives the initial pulse width modulation signal PWMB and counts during the frequency cycle of the initial pulse width modulation signals PWMB to generate a frequency cycle count TP and a duty cycle count TD of the initial pulse width modulation signal PWMB. In this embodiment, the counting circuit 100 may include a counter 111, a frequency cycle register 113 and a duty cycle register 115. At the rising edge of the initial pulse width modulation signal PWMB, the frequency cycle register 113 and the duty cycle register 115 are reset and the counter 111 is triggered to write counts in the frequency cycle counter register 113 and the duty cycle count register 115. Then, when the falling edge of the initial pulse width modulation signal PWMB comes, the counter 111 stops to write counts in the duty cycle register 115 to thereby obtain the duty cycle count TD and continues to write counts in the frequency cycle register 113. Next, when the next rising edge of the initial pulse width modulation signal PWMB arrives, the frequency cycle register 113 outputs the frequency cycle and resets the TP, and the duty cycle register 115 outputs the duty cycle count TD and resets the TD.

The calculating circuit 130 receives the frequency cycle count TP and the duty cycle count TD outputted by the counting circuit 110, and calculates the duty cycle of the initial pulse width modulation signal PWMB during the frequency cycle as an output, based on the frequency cycle count TP and the duty cycle count TD. Here, the calculating circuit 130 may comprise a divider to obtain the quotient of the frequency cycle count TP and the duty cycle count TD as the duty cycle of the initial pulse width modulation signal PWMB, and the duty cycle can be presented in digital format.

The PWM signal generating circuit 150 receives the frequency cycle count TP and the duty cycle count TD outputted by the counting circuit 110, and implements an algorithm according to the frequency cycle count TP and the duty cycle count TD to generate a new pulse width modulation signal. The implementation of the algorithm is to make the duty cycle of the new pulse width modulation signal to be the quotient of the duty cycle of the initial pulse width modulation signal PWMB divided by the preset threshold value. The preset threshold value is as a boundary line of the duty cycle of the initial pulse width modulation signal PWMB, to drive the LED to selectively work with the DC dimming mode or the PWM dimming mode. In this embodiment, the duty cycle is presented in digital format; therefore, a preferred preset threshold value is 25%, but not limited to the value in the present invention. The preset threshold value can also be 12.5% or 50%. If the duty cycle is presented in analog format, the preset threshold value can be any value.

The driving current setting circuit 170 is electrically coupled to the calculating circuit 130, and coupled to the PWM signal generating circuit 150 through a switch S1-*a* to set the duty cycle of the LED driving current and the current value. In this embodiment, the driving current setting circuit 170 may comprise a first digital signal generating circuit 171, a second digital signal generating circuit 173, a digital/analog converting circuit 175, a current generating circuit 177 and comparator circuit CMP. Among them, the first digital signal generating circuit 171 generates a first digital signal according to the preset threshold value, for example, the digital value of the preset threshold value. The second digital signal generating circuit 173 generates a second digital signal according to the duty cycle outputted by the calculating circuit 130, for example, the digital value of the duty cycle outputted by the calculating circuit 130. The digital/analog converting circuit 175, respectively through the switches S1-*b* and S2, is electrically coupled to the first digital signal generating circuit 171 and the second digital signal generating circuit 173 to receive the first and second digital signals and convert the digital signals into analog signals. The current generating circuit 177 is electrically coupled to the digital/analog converting circuit 175, to receive the analog signals and generate the current value of the LED driving current $I_{LED}$ with reference to the preset maximum gray-scale current Iset. The comparator circuit CMP has its controlling end to receive control signal of the new PWM signal generated by the PWM signal generating circuit 150, through the switch S1-*a*. That is, when the switch S1-*a* is turned on, the duration that the output of the comparator circuit CMP is at a high level is determined by the duty cycle of the new PWM signal, and the LED works in the PWM dimming mode. Whereas, when the switch S1-*a* is turned off, the output of the comparator circuit CMP is continuously maintained at the high level (the corresponding duty cycle of the driving current $I_{LED}$ duty cycle being 100%) to make the driving transistor T1 conducted, and the LED works in the DC dimming mode. Furthermore, the non-inverting input of the comparator circuit CMP receives the driving current $I_{LED}$ provided by the current generating circuit 177, while the inverting input of the comparator circuit CMP is electrically coupled to the source/drain of the driving transistor T1 to receive a feedback current $I_{FB}$ from the LED. The drain/source of the driving transistor T1 is electrically connected to LED.

The dimming mode selecting circuit 190 is electrically coupled to the calculating circuit 130, the switches S1-*a*, S1-*b* and S2. The relative relationship between a magnitude of the duty cycle of the initial pulse width modulation signal PWMB outputted by the calculating circuit 130 and the preset threshold value is determined by the dimming mode selecting circuit 190. It is determined according to the relative relationship whether the switch S1-*a* is opened to provide a new PWM signal to the comparator circuit CMP, so that to determine which one of the PWM dimming mode and the DC dimming mode the LED works with. Specifically, when the duty cycles outputted by the calculating circuit 130 is less than the preset threshold value, the dimming mode selecting circuit 190 enables the switches S1-*a* and S1-*b* and turns off the switch S2, so that the LED works with the PWM dimming mode. On the other hand, when the duty cycles outputted by the calculating circuit 130 is no less than preset threshold value, the dimming mode selecting circuit 190 enables the switch S2 and turns off the switches S1-*a* and S1-*b*, so that the LED works with the DC dimming mode.

Figure 3:
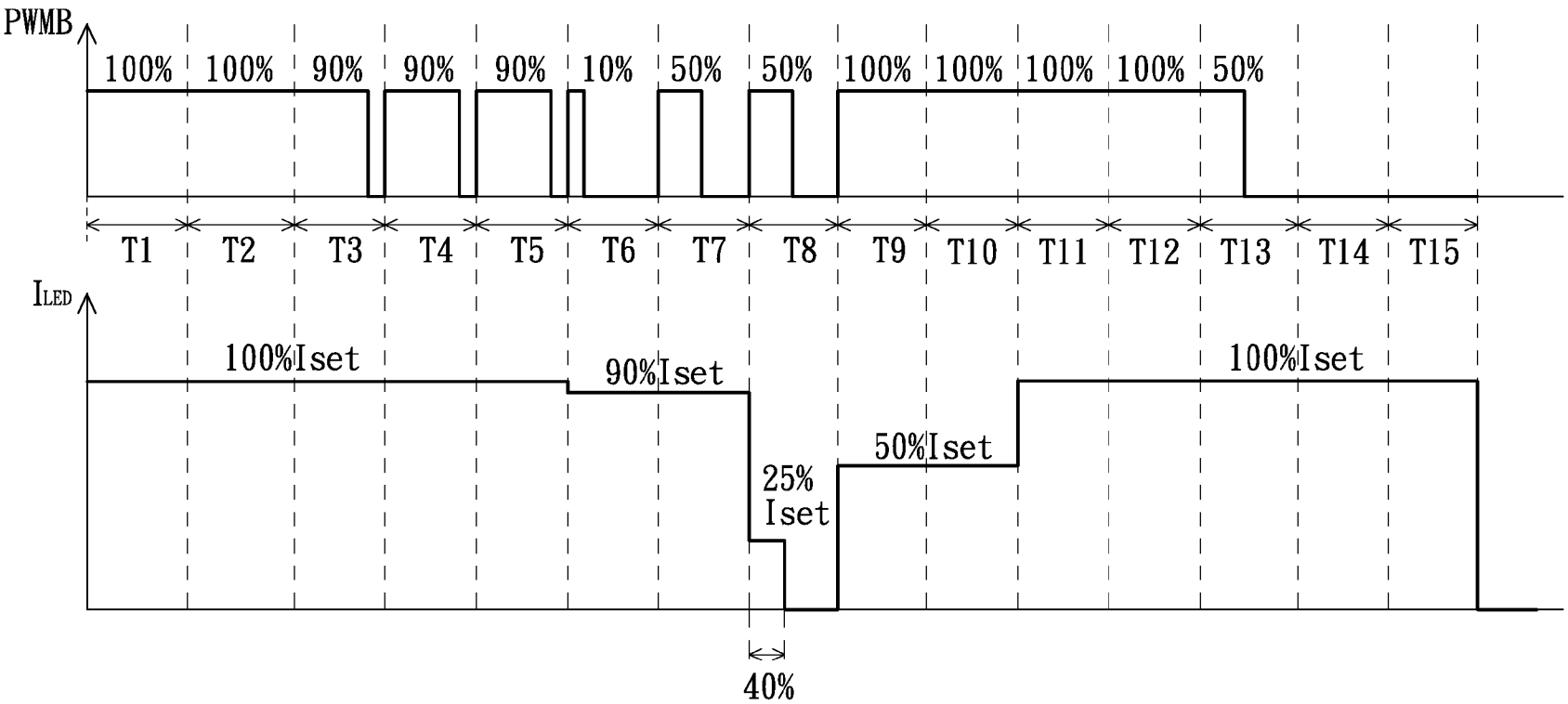
FIG. 3 is a timing diagram of multiple signals of a LED driving method which is implemented by the LED driving circuit as shown in FIG. 2.

Please referring to FIG. 3, it is a timing diagram of multiple signals of a LED driving method which is implemented by the LED driving circuit 100 as shown in FIG. 2.

Similar to FIG. 1, the LED driving method of this embodiment as shown in FIG. 3 may also comprises steps of: providing a pulse width modulation signal PWMB to determine the brightness of the LED, obtaining a duty cycle of the pulse width modulation signal PWMB, and selectively enabling the LED to work with a PWM dimming mode or a direct current (DC) dimming mode according to a relative relationship between a magnitude of the obtained duty cycle and a preset threshold value (still 25% as an example). The duty cycle of the pulse width modulation signal PWMB in this embodiment can be obtained through the following steps: Firstly, counting in the frequency cycle of the pulse width modulation signal PWMB, to obtain the frequency cycle count and the duty cycle count of the initial PWM signal; then calculating the duty cycle of the initial PWM signal in the frequency cycle according to the frequency cycle count and the duty cycle count.

In FIG. 3, it is supposed that one frequency cycle of the initial pulse width modulation signal PWMB is occupied for the LED driving circuit 100 in FIG. 2, respectively to obtain each of the frequency cycle count TP and the duty cycle count TD and to calculate the duty cycle. Therefore, Default setting of the current value in the initial two frequency cycles is Iset and the default setting of the duty cycle in the initial two frequency cycles is 100%, wherein the initial two frequency cycles are corresponded to the frequency cycles to obtain the duty cycle of the initial pulse width modulation signal PWMB. While, driving of the LED driving circuit 100 on the LED is correspondingly delayed two frequency cycles.

Specifically, as shown in FIG. 3, the duty cycles of the initial pulse width modulation signal PWMB in its consecutive thirteen frequency cycles T1~T13 are in turn 100%, 100%, 90%, 90%, 90%, 10%, 50%, 50%, 100%, 100%, 100%, 100% and 50%. When the duty cycle is more than and equal to 25%, for example, equal to 100%, 90% and 50%, the LED is enabled to work with the DC dimming mode and the duty cycle of the PWM signal is used to set the amplitude of the LED driving current $I_{LED}$, for example, 100% Iset, 90% Iset and 50% Iset. When the duty cycle is less than 25%, for example, equal to 10%, the LED is enabled to work with the PWM dimming mode, the current value of the LED driving current $I_{LED}$ is fixed to the product of 25% (the preset threshold value) and the maximum gray-scale current Iset, such as 25% Iset, and the duty cycle of the driving current $L_{LED}$ is set to the quotient of the duty cycle of the pulse width modulation signal PWMB divided by 25% (the preset threshold value), such as 10%/25%=40%.

It is worth to be mentioned, in FIG. 3, after the duty cycle of the initial pulse width modulating signal PWMB is maintained to be 100% in two consecutive frequency cycles, the duty cycle in the subsequent frequency cycles is directly set to 100% by the LED driving circuit 100 until the rising edge of the initial pulse width modulation signal PWMB is detected. For example, in FIG. 3, the duty cycle of the initial pulse width modulation signal PWMB in the third frequency cycle is 90% (after the first and second frequency cycles in which the duty cycle is 100%), the driving of the LED driving circuit 100 on the LED is reflected in the fifth frequency cycle T5, so the current value of the driving current $I_{LED}$ is still 100% Iset rather than 90% Iset.

Additionally, it also can be found in FIG. 3, if the rising edge of the initial pulse width modulation signal PWMB is not detected in two consecutive frequency cycles after the falling edge of the initial pulse width modulation signal PWMB, the LED is then closed. For example, in FIG. 3, the falling edge arrives at the thirteenth frequency cycle of the initial pulse width modulation signal PWMB, and no rising edged of the initial pulse width modulation signal PWMB is detected by the LED driving circuit 100 at the fourteenth and fifteenth frequency cycles; then it is determined that input of the initial pulse width modulation signal has stopped and the LED is closed.

Summarily, in the embodiments of the present invention, the LED is performed with a two stage brightness control by use of mixed dimming mode according to the best pin rate curve of driving LED, so that the duty cycle and the current value of the LED driving current are adjusted according to usage of the LED. Therefore, it can enable the LED works with the best operating current, and the driving efficiency of the LED can be effectively improved.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A light emitting diode driving method, comprising steps of:

providing a first pulse width modulation signal to determine brightness of a light emitting diode;

obtaining a duty cycle of the first pulse width modulation signal; and selectively enabling the light emitting diode to work with a pulse width modulation dimming mode or a direct current dimming mode according to a relative relationship between a magnitude of the duty cycle and a preset threshold value;

wherein the step of selectively enabling the light emitting diode to work with the pulse width modulation dimming mode or the direct current dimming mode according to the relative relationship between the magnitude of the duty cycle and the preset threshold value comprises:

enabling the light emitting diode to work with the pulse width modulation dimming mode when the duty cycle is less than the preset threshold value; and enabling the light emitting diode to work with the direct current dimming mode when the duty cycle is no less than the preset threshold value.

2. The light emitting diode driving method according to claim 1, wherein when the light emitting diode works with the pulse width modulation dimming mode, the duty cycle of a driving current for the light emitting diode is determined by the duty cycle of the first pulse width modulation signal and the preset threshold value and a current value of the driving current in the duty cycle of the driving current is determined by a maximum gray-scale current value of the light emitting diode and the preset threshold value.

3. The light emitting diode driving method according to claim 1, wherein when the light emitting diode works with the direct current dimming mode, a current value of a driving current for the light emitting diode is determined by a maximum gray-scale current value of the light emitting diode and the duty cycle of the first pulse width modulation signal.

4. The light emitting diode driving method according to claim 1, wherein the step of obtaining the duty cycle of the first pulse width modulation signal comprises:

counting during a frequency cycle of the first pulse width modulation signal to obtain a frequency cycle count and a duty cycle count of the first pulse width modulation signal; and calculating the duty cycle of the first pulse width modulation signal during the frequency cycle according to the frequency cycle count and the duty cycle count.

5. The light emitting diode driving method according to claim 4, wherein the step of obtaining the duty cycle of the first pulse width modulation signal further comprises:

directly setting the duty cycle in the subsequent frequency cycle to be 100% until a rising edge of the first pulse width modulation signal is detected, after the duty cycle of the first pulse width modulation signal is maintained to be 100% in two consecutive frequency cycles.

6. The light emitting diode driving method according to claim 4, further comprising:

turning off the light emitting diode when a rising edge of the first pulse width modulation signal is not detected in two consecutive frequency cycles after the falling edge of the first pulse width modulation signal.

7. The light emitting diode driving method according to claim 4, wherein the step of enabling the light emitting diode to work with the pulse width modulation dimming mode when the duty cycle is less than the preset threshold value comprises:

generating a digital signal according to the preset threshold value;

implementing an algorithm according to the frequency cycle count and the duty cycle count to generate a second pulse width modulation signal; and respectively setting the duty cycle of a driving current for the light emitting diode and the current value of the driving current in the set duty cycle, according to the digital signal of the second pulse width modulation signal;

wherein the implementation of the algorithm is to make the duty cycle of the second pulse width modulation signal to be the quotient of the duty cycle of the first pulse width modulation signal divided by the preset threshold value.

8. The light emitting diode driving method according to claim 4, wherein the step of enabling the light emitting diode to work with the direct current dimming mode when the duty cycle is no less than the preset threshold value comprises:

generating a digital signal according to the duty cycle; and setting the current value of a driving current for the light emitting diode, according to the digital signal.

9. The light emitting diode driving method according to claim 1, wherein the preset threshold value is 25%.

10. A light emitting diode driving circuit, comprising:

a counting circuit, receiving the first pulse width modulation signal and counting during a frequency cycle of the first pulse width modulation signal to generate a frequency cycle count and a duty cycle count of the first pulse width modulation signal, wherein the first pulse width modulation signal determines brightness of a light emitting diode;

a calculating circuit, calculating a duty cycle of the first pulse width modulation signal during the frequency cycle, according to the frequency cycle count and the duty cycle count;

a pulse width modulation signal generating circuit, generating a second pulse width modulation signal by implementing an algorithm according to the frequency cycle count and the duty cycle count;

a driving current setting circuit, electrically coupled to the calculating circuit and the pulse width modulation signal generating circuit; and a dimming mode selecting circuit, determining relative relationship of magnitude of the duty cycle of the first pulse width modulation signal and a preset threshold value, and determining whether the second pulse width modulation signal is provided to the driving current setting circuit according to the relative relationship to selectively enable the light emitting diode to work with a pulse width modulation dimming mode with which a duty cycle of a driving current for the light emitting diode is set according to the second pulse width modulation signal, or a direct current dimming mode.

11. The light emitting diode driving circuit according to claim 10, wherein the driving current setting circuit comprises:

a first digital signal generating circuit, generating a first digital signal according to the preset threshold value;

a second digital signal generating circuit, generating a second digital signal according to the duty cycle;

wherein when the light emitting diode is driven by the driving current setting circuit to work with the pulse width modulation dimming mode, the driving current setting circuit is controlled by the dimming mode selecting circuit to select the first digital signal to set the current value of the driving current during the duty cycle;

when the light emitting diode is driven by the driving current setting circuit to work with the direct current dimming mode, the driving current setting circuit is controlled by the dimming mode selecting circuit to select the first digital signal to set the current value of the driving current.

12. The light emitting diode driving circuit according to claim 11, wherein the driving current setting circuit further comprises:

a digital/analog converting circuit, converting the selected one of the first digital signal and the second digital signal to an analog signal;

a current generating circuit, generating the current value of the driving current according to the analog signal and a reference current; and a comparator circuit, determining the lighting time of the light emitting diode and comprises a controlling end, a first input and a second input, the controlling end electrically coupled to the pulse width modulation signal generating circuit to determine which one of the pulse width modulation dimming mode and the direct current dimming mode the light emitting diode driven by the driving current setting circuit works with, and the first input receiving the current value outputted by the current generating circuit, and the second input receiving a feedback current from the light emitting diode.

13. A light emitting diode driving method, comprising steps of:

obtaining a duty cycle of an initial pulse width modulation signal which determines brightness of the light emitting diode;

when the duty cycle of the initial pulse width modulation signal is less than a preset threshold value, respectively setting a duty cycle of a driving current for the light emitting diode and a current value of the driving current during the set duty cycle to be D %/T and Iset×T, wherein D % is the value of the duty cycle of the driving current, T is the threshold value, 0<T<1, Iset is a preset maximum gray-scale current of the light emitting diode; and when the duty cycle of the initial pulse width modulation signal is no less than the preset threshold value, respectively setting the duty cycle of the driving current and the current value of the driving current during the duty cycle of the driving current to be 100% and Iset×D %.

14. The light emitting diode driving method according to claim 13, wherein the threshold value is 25%.

* * * * *